US005207378A

United States Patent [19]

Detchon

[11] Patent Number: 5,207,378

[45] Date of Patent: May 4, 1993

[54] MAILBOX DECORATIVE ATTACHMENT

[76] Inventor: Susan L. M. Detchon, Motherload Products Development Corp., P.O. Box 7664, Greenwich, Conn. 06836

[21] Appl. No.: 810,282

[22] Filed: Dec. 19, 1991

[51] Int. Cl.[5] ..... A47G 29/12

[52] U.S. Cl. ..... 232/38; 156/257; 232/17

[58] Field of Search ..... 428/7, 8, 12, 13; 232/17, 45, 38; D99/29

[56] References Cited

U.S. PATENT DOCUMENTS

| | | | |
|---|---|---|---|
| 3,995,388 | 12/1976 | Penick et al. | 428/12 X |
| 4,367,844 | 1/1983 | Drummond | 232/17 |
| 4,813,595 | 3/1989 | Johns, Jr. et al. | D99/29 |
| 4,991,769 | 2/1991 | Todd | 232/17 |
| 5,000,379 | 3/1991 | LaRue | 232/17 |
| 5,054,685 | 10/1991 | Roach | 232/17 |
| 5,106,016 | 4/1992 | Beckmann | 232/38 X |

OTHER PUBLICATIONS

Funbox Co. price List With Illustrations West Willington, Conn. copyrighted 1989.

Sheet of Photographs of Mailboxes Animail Boxes, Inc. Greenwich, Conn.

*Primary Examiner*—Henry F. Epstein

*Attorney, Agent, or Firm*—Alfred E. Miller

[57] ABSTRACT

A mailbox decorative attachment being a flat sheet which is cut out to form a pictorial or silouetted representation and which is adhered to the curved outer surface of the mailbox and in which a portion of the pictorial representation projects outside, and may be under, above or around the mailbox configuration to form a substantial three-dimensional part of the picture.

9 Claims, 3 Drawing Sheets

MAILBOX DECORATIVE ATTACHMENT

The present invention relates to a method of making and applying a decorative attachment to a mailbox, as well as the resulting product.

BACKGROUND OF THE INVENTION

Previously, stand-alone mailboxes placed adjacent to a road for mail delivery were painted or covered on both sides of the mailbox with a picture. The picture appeared on the flat side surfaces facing the road. Consequently, the painted pictures, which may be in the form of birds, dogs, or the like, were flat and did not project depth.

In order to produce a mailbox pictorial cover having depth it is known from the present applicant to have a mailbox with an outer cover of a weatherproof material provided with a pictorial background and, for example, an animal or a fish having a portion such as a head or tail projecting from the outer surface of the mailbox. This decorative mailbox is expensive to fabricate since the mailbox and decorative attachment is purchased as a single unit. On the other hand, in order to overcome the cost of such a mailbox and to provide means whereby the ordinary homeowner could convert his or her plain mailbox to a decorative mailbox, the present method has been devised to die cut a single sheet of slightly flexible material having two substantially identical parts and provided with a common connecting point so that the flexible material having pictorial material thereon can be applied to a standard mailbox much less expensively than the prior art construction, and achieve substantially the same look as the previously known construction. Furthermore all constructions and designs comply with current postal regulations.

It appears that residents who live on a rural mail route may have a vocation, or an avocation, and would like a dynamic representation of their interests depicted on their mailbox inexpensively.

SUMMARY OF THE INVENTION

It is an object of the present invention to provide a method of fabricating a decorative attachment for a mailbox from a single sheet of slightly flexible material, which is die cut, and having two similiar but slightly different parts which are connected by a common connecting point. The die cut sheet is so formed that parts of the sheet are applied to the opposite sides of a mailbox while the other parts which are mirror images of each other and adjacent to the connecting point project away from the mailbox. Consequently, the projecting parts from the mailbox give the appearance of depth, and are more or less three-dimensional.

A further object of the present invention is to provide a die cut flexible sheet for applying to a standard mailbox having an adhesive on opposite inside surfaces of the sheet for securing the sheet to the mailbox with drawings on the outer surfaces representing either an animate or inanimate object, and where parts of the flexible sheet with the pictorial representations thereon project outside of the mailbox to form a character.

Another object of the present invention is to provide a mailbox cover which remains intact even in the event the mailbox itself is dented or otherwise damaged.

A further feature of the present invention is to provide a mailbox cover which can be readily removable in order to affix another mailbox cover with another picture, legend, or motif.

An object of the present invention is to provide projecting parts of the flexible sheet which may either protrude from the top, sides, front, bottom or rear of the mailbox.

BRIEF DESCRIPTION OF THE DRAWINGS

The foregoing objects and features of my invention will be more fully understood by the following description of the construction and method in the specification and by reference to the accompanying drawings forming a part thereof and in which.

DESCRIPTION OF THE PREFERRED EMBODIMENTS

Figure 1:
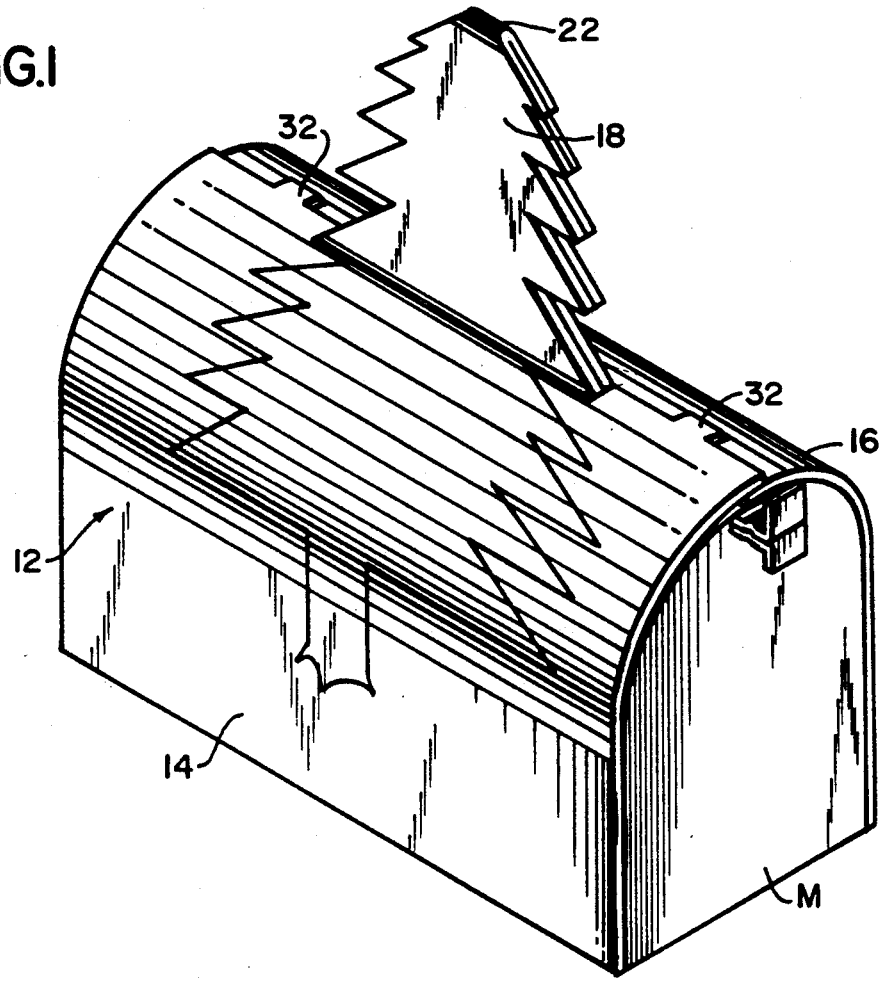
FIG. 1 is a perspective view of the mailbox decorative attachment fabricated and applied in accordance with the teachings of my invention.
Figure 2:
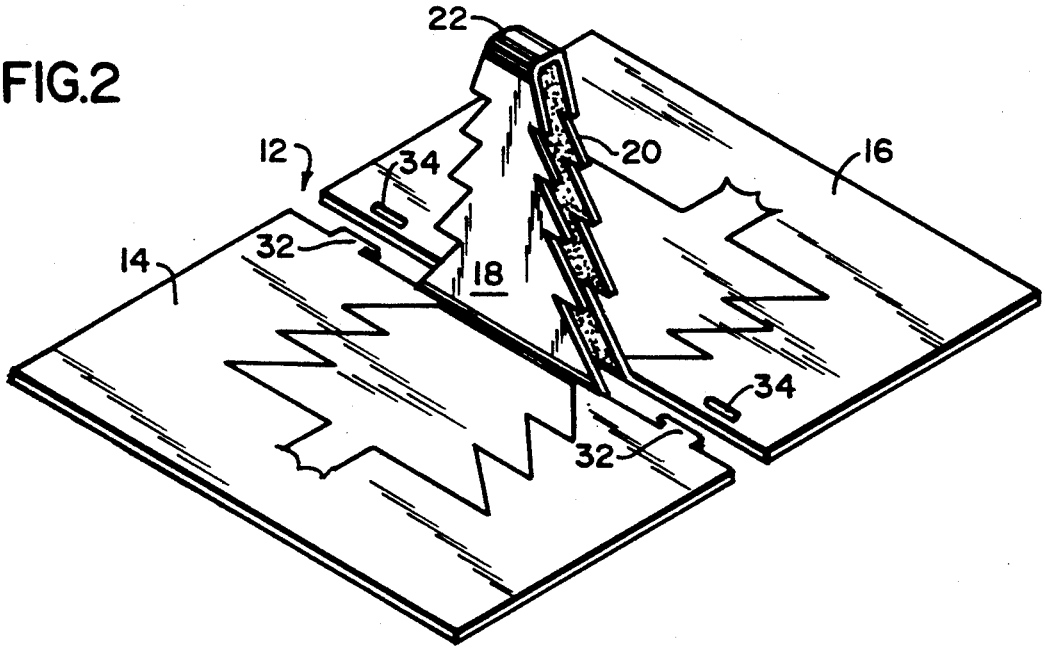
FIG. 2 is a perspective view of a die cut slightly flexible sheet which has been cut-out and provided with two parts connected at a common point.
Figure 4:
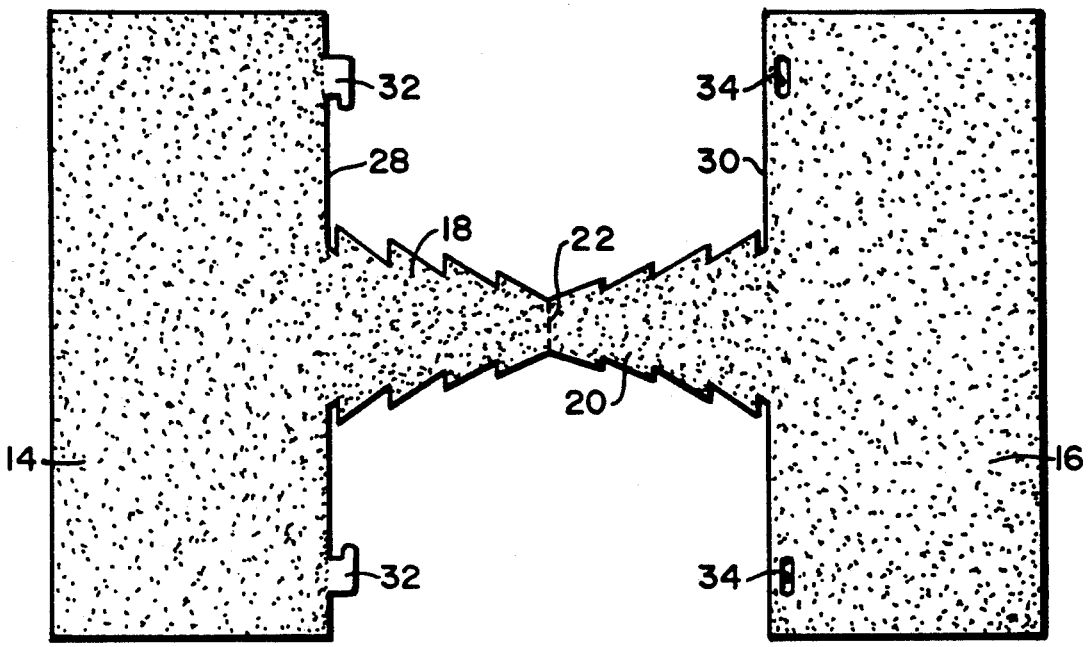
FIG. 4 is a bottom plan of the die cut sheet of FIG. 3 showing adhesive applied to the bottom surface thereof.
Figure 3:
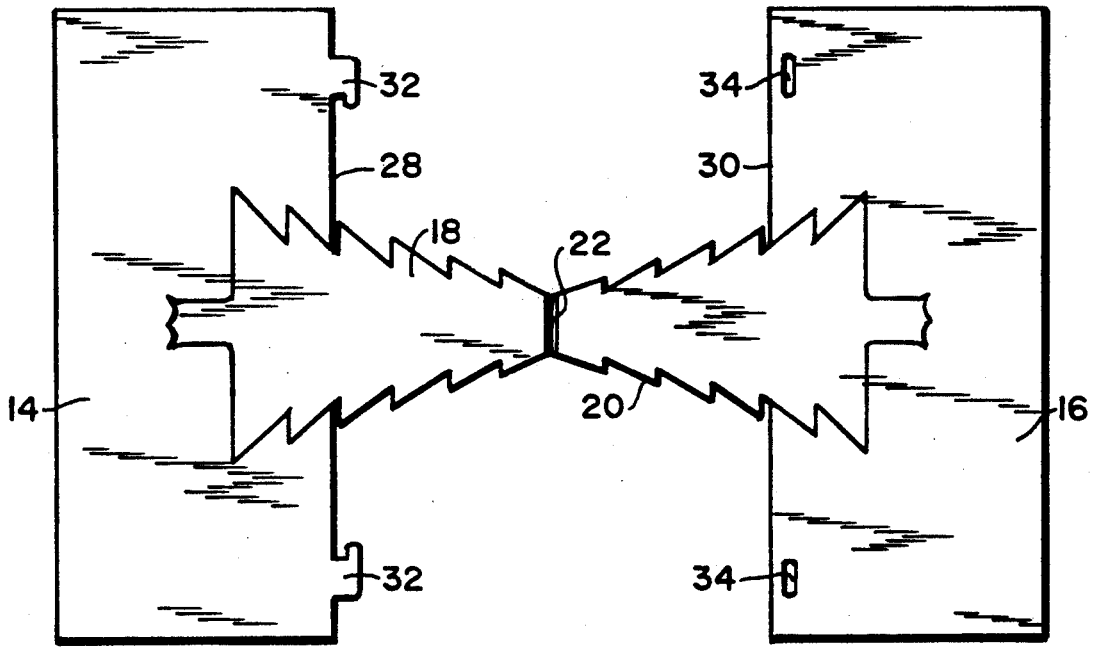
FIG. 3 is a top plan view showing the flat die cut sheet having opposing mirror image parts connected at a common point prior to attachment to a mailbox.
Figure 5:
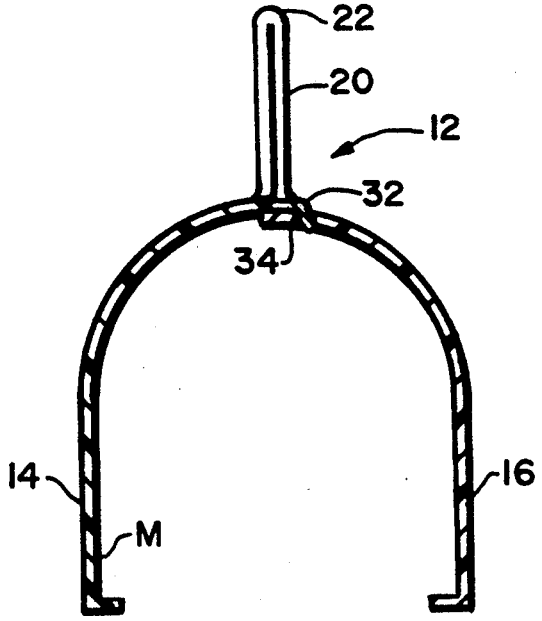
FIG. 5 is a front elevational view of the assembled mailbox corner having a pictorial representation.
Figure 6:
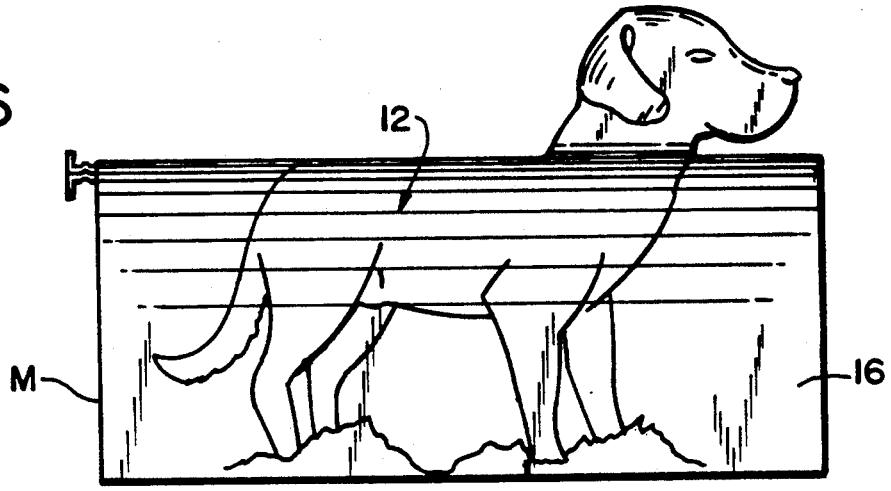
FIG. 6 is a side elevational view of a mailbox cover provided with a pictorial representation.
Figure 7:
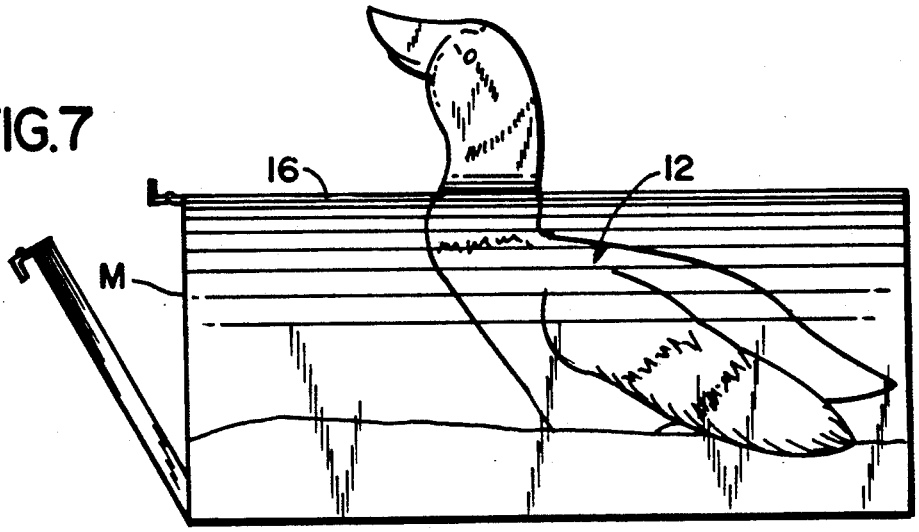
FIG. 7 is a side elevational view of another mailbox cover having a further pictorial representation.

The present invention relates to a method for making a decorative attachment cover for mailbox M and applying the same thereto. The mailbox cover referred generally by the reference numeral 12 is fabricated of a sheet of flexible but fairly rigid material, such as thermoplastic resin or silicone rubber material. The pictorial representation may be a Christmas tree, as seen in FIGS. 1–5, or animate objects, such as a dog as seen in FIG. 6, or a duck in FIG. 7. It should be evident that a large number of pictorial representation, and blank silhouettes for individual coloring may be selected and not just those shown by way of illustration herein. As seen in FIG. 2, the sheet of material is die cut for a particular pictorial representation, and is painted or otherwise applied to the exterior surface thereto. The sheet 12 is provided with parts 14 and 16 having mirror image sections 18 and 20 connected at a common point 22. In order to effectively connect the parts 14 and 16 of the cover 12 so that the edges 28 and 30 of the respective parts are aligned and abutting when the cover is applied to the curved outer surface of the mailbox, and as seen in FIGS. 1 and 2, tabs 32 on part 14 are inserted in the corresponding slots 34 on part 16. The flat sheet is provided with adhesive surfaces 24 on the inside surfaces of parts 14 and 16 as shown in FIGS. 2 and 3. Initially, the adhesive surfaces 24 are provided with peel-off covers (not shown) which can be removed in the usual manner prior to applying the adhesive surface on the inside of the flat sheet to the opposite sides of the curvilinear outside surfaces of a mailbox, and consequently securing the sheet thereto.

When the mailbox cover sheet 12 is applied to the mailbox the common connecting point 22 of the sections is positioned outside the mailbox, either above, in the rear, bottom on the front or on sides thereof. The mirror image sections 18 and 20 are pressed together, or are otherwise attached to form a substantially three-dimensional part of the pictorial representation which is displaced from the body of the mailbox.

It is also contemplated within the present inventive concept to cut out parts of a flat sheet to form a mailbox cover with a portion projecting beyond at least one surface of the mailbox, and in which the cut-out sheet is unadorned until the user draws, designs, colors or styles the sheets for a particular purpose, for example to commemorate an important event.

While the present invention has been disclosed and described with reference to certain embodiments thereof it is apparent that other variations and modifications may be made which fall within the true scope of the invention, as defined in the following claims:

What I claim:

1. A method for making a decorative attachment cover for a mailbox comprising the steps of:

(A) Die cutting a flat sheet of bendable material into two parts being connected at a common point, the back of said flat sheet being provided with an adhesive, (B) Securing the back of each part of the bendable material to opposite sides of the mailbox with a common point projecting outside of said mailbox, and (C) Assembling the connected parts adjacent to the common point in back to back relationship and adhering said parts together whereby a two-sided pictorial representation is provided displaced from said mailbox.

2. A method for making a decorative attachment cover for a mailbox comprising the steps of:

(A) Cutting a flat sheet of bendable material into two parts being connected at a common point, (B) Applying each of said parts to opposite sides of said mailbox with a common connecting point outside the mailbox and, (C) Said common point and the adjacent parts thereof being adhered together in back to back relationship being displaced from said mailbox thus forming a substantially three-dimensional animate or inanimate object.

3. A method as claimed in claim 1 further comprising the step of providing at least one tab on one of said parts and a slot on said other part and inserting said tab in said slot to interconnect the two parts after said parts are fitted over said mailbox.

4. A method as claimed in claim 3 wherein each of said parts is a rectangular sheet provided with an integral extension connected at such common point, said tab being on a marginal edge of one of said parts, said corresponding slot being on an opposing marginal edge of said other parts, and inserting said tab in said slot in order to further connect said parts to form a cover for securing to the outer surface of said mailbox while said extensions are projected outside of said mailbox.

5. A method as claimed in claim 1 further providing at least one slot in one part of said sheet, and at least one tab on the other part of said sheet whereby said tab is inserted in said slot hen assembling said connected parts.

6. A decorative attachment cover for a mailbox comprising a bendable cover for the sides and top thereof having an adhesive surface on an inside surface thereof, said bendable cover being in two substantially identical parts that are connected at a common point, one of said parts having at least one slot therein and the other part having a tab for insertion in said slot when said cover is bent to conform to the outer surfaces of said mailbox, and the portions of said cover adjacent to said common point when the cover is secured by adhesive to said outside surfaces of a said mailbox forming a pictorial two-sided or a non-pictorial substrate being displaced from said mailbox, and secured together by means of back to back adhesive surfaces.

7. An attachment as claimed in claim 6 wherein said bendable cover is fabricated of a silicone rubber material.

8. An attachment as claimed in claim 6 wherein said bendable cover is made from a thermoplastic resin.

9. An attachment as claimed in claim 6 wherein said identical parts are mirror images of each other.

* * * * *